United States Patent [19]

Tabler et al.

[11] 4,265,733

[45] May 5, 1981

[54] DE-ASHING LUBRICATING OILS

[75] Inventors: Donald C. Tabler; Bobby G. Gray, both of Bartlesville, Okla.

[73] Assignee: Phillips Petroleum Company, Bartlesville, Okla.

[21] Appl. No.: 90,183

[22] Filed: Nov. 1, 1979

[51] Int. Cl.[3] ..... C10M 11/00

[52] U.S. Cl. ..... 208/179; 208/180

[58] Field of Search ..... 208/179, 181, 182

[56] References Cited

U.S. PATENT DOCUMENTS

| | | | |
|---|---|---|---|
| 2,545,806 | 3/1951 | Davis | 208/252 |
| 2,771,882 | 2/1957 | Ambler | 208/179 |
| 2,963,525 | 12/1960 | Folz et al. | 585/530 |
| 3,173,859 | 3/1965 | Chambers | 208/184 |
| 3,625,881 | 12/1971 | Chambers et al. | 208/179 |
| 3,791,965 | 2/1974 | Fitzsimons et al. | 208/179 |
| 3,879,282 | 4/1975 | Johnson | 208/184 |
| 3,923,644 | 12/1975 | Hindman | 208/179 |
| 3,930,988 | 1/1976 | Johnson | 208/182 |
| 4,151,072 | 4/1979 | Nowack et al. | 208/182 |

OTHER PUBLICATIONS

"Elements of Chemical Engineering", by Badger et al, 1936, McGraw-Hill Book Co., N.Y., p. 518.

"Chemical Engineering Progress", vol. 49, No. 1, Jan. 1953, pp. 26 to 34.

"Chemical Engineering", Nov. 3, 1969, pp. 79 & 80.

*Primary Examiner*—Herbert Levine

[57] ABSTRACT

In a process for reducing the concentration of ash-forming components in a lubricating oil wherein a feedstream comprising said lubricating oil and an aqueous ammonium salt treating agent is continuously passed into a first reaction zone wherein said treating agent reacts with ash-forming components in said oil and an effluent is continuously withdrawn from said first reaction zone and subjected to filtration after removal of water therefrom, the improvement comprising introducing said feedstream into said first reaction zone by passing said feestream through a centrifugal pump along with portions of the contents of said first reaction zone.

8 Claims, 1 Drawing Figure

DE-ASHING LUBRICATING OILS

Figure 1:
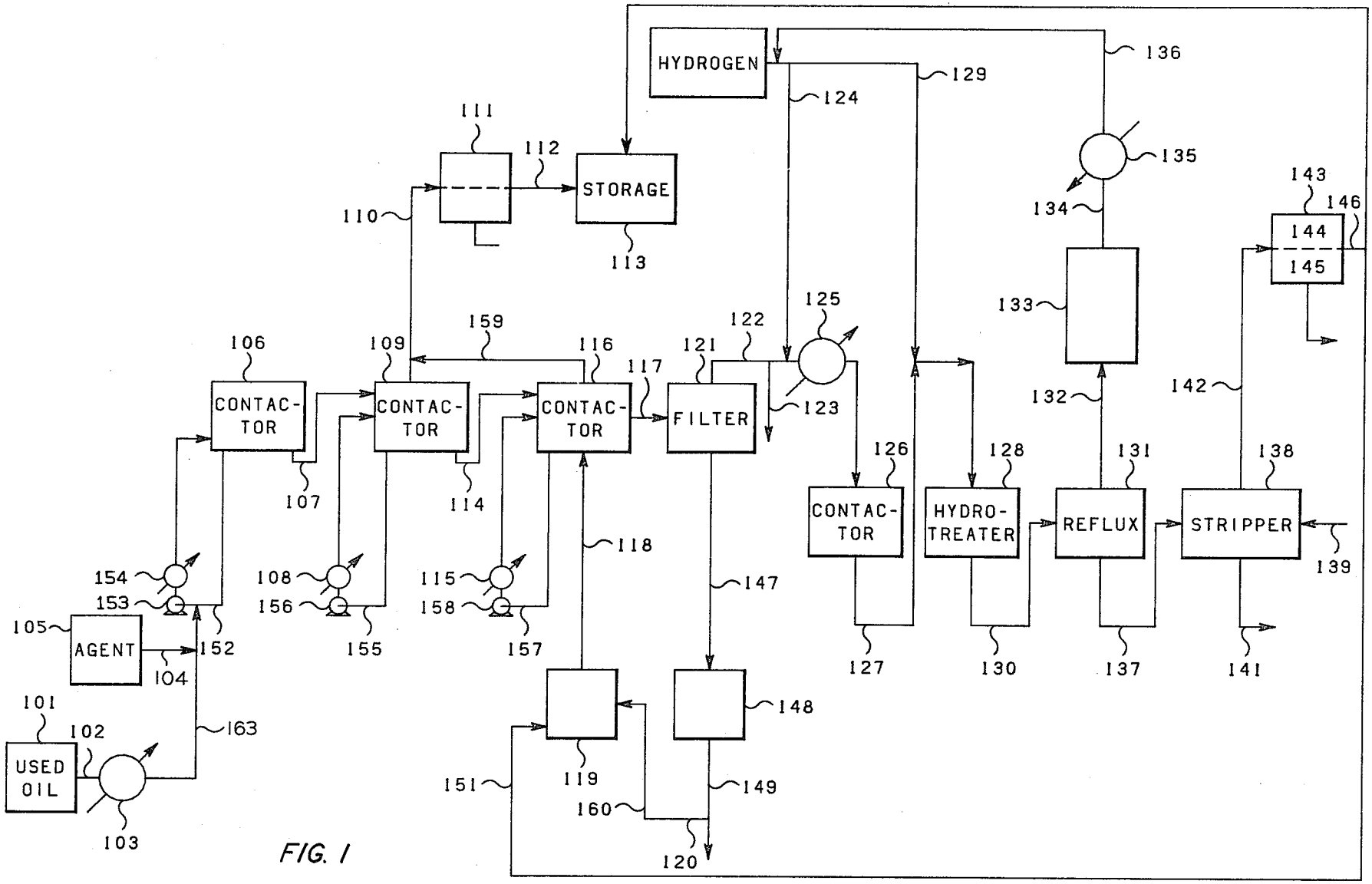

This invention relates to a method for reducing the ash-content of lubricating oil containing ash-forming components. In another aspect, this invention relates to a method for the treatment of used lubricating oils to obtain purified oil suitable for use as fuel oil, in grease formulations, or in the preparation of lubricating oil formulations.

Used motor oil has been estimated as being generated in the United States at a rate of about 1.1 billion gallons per year. Some of this used oil has been used as furnace oil and some has been used on rural dirt roads for dust control. Much of the oil has been merely discarded in sewers, dumps, and back alleys. With the ever decreasing petroleum reserves, it becomes more and more essential that this used oil be saved and used as long as possible.

One major obstacle to re-use of used oil involves the presence of various ash-forming impurities that remain dispersed in the oil due to the very effective dispersant characteristics of the additives in modern day lubricant systems.

Materials contained in a typical used crankcase oil that are considered to contribute to the ash content of the oil include sub-micron size carbon particles, inorganic materials such as atmospheric dust, metal particles, lead and other metal compounds originating from fuel combustion. Besides lead, which is generally present at concentrations of 1.0 to 2.5 weight percent, appreciable amounts of zinc, barium, calcium, phosphorus and iron are also present in the used crankcase oil. Examination of the used oil under an optical microscope at 600 magnifications reveals the very effective dispersant characteristics of modern day lube oils. The particle size of the particulates is estimated from this microscopic examination to be 0.1–1.0 microns with virtually no occurrence of agglomerates in the oil.

The presence of the ash-forming components in used oil puts limits on the extent to which the material can be used economically without ecological damage. For example, reuse of the used oil as fuel oil can give rise to serious atmospheric pollution when the oil contains in excess of one percent lead. Also, such fuel oil often results in burner and refractory maintenance costs that offset the purchase price differential between used oil and regular furnace oil.

Clearly, it is in the national interest to provide economical ways of removing the impurities from used oil so that it can be reused practically.

Recently, a technique of purifying used oil has been developed in which the used oil is reacted with an aqueous solution of an ammonium salt treating agent, then the water phase is removed, and the resulting oil phase-containing mass is separated by filtration. Such a technique is described in U.S. Pat. No. 4,151,072, the disclosure of which is incorporated herein by reference.

In such a process, the separation of the ash-forming components from the oil is dependent upon the extent to which the ammonium salt treating agent reacts with those components. In U.S. Pat. No. 4,151,072 there is disclosed the process of reacting the treating agent and the ash-forming components by passing the oil and the treating agent into a reaction zone where the mixture is subjected to agitation provided by means such as a stirrer. It also discloses using a pump to recycle portions of the mixture to the reaction zone.

While the use of only a stirring means in the reaction zone has proven adequate for batch reactions, it has not been found to be as effective when the mixture is passed through the reaction zone in a continuous flow-through manner wherein a feed comprising the oil and the treating agent is continuously passed into the reaction zone and effluent from the reaction zone is continuously withdrawn.

An object of the present invention is to increase the extent of reaction of the treating agent and the ash-forming components when the mixture of oil and treating agent is passed through the reaction zone in a continuous flow-through manner.

Another object of this invention is to provide an improved integrated process for reclaiming a high-purity lube oil stock from high-detergent-containing used lubricating oils.

A further object of this invention is to provide an improved process for removing impurities from used lubricating oils.

Other aspects, objects and the several advantages of this invention will be apparent to one skilled in the art upon study of the disclosure, the claims and the drawings, which is a schematic representation of the process of the invention.

This invention is based upon the discovery that in a process for reducing the concentration of ash-forming components in a lubricating oil wherein a feed stream comprising said lubricating oil and an aqueous ammonium salt treating agent is continuously passed into a first reaction zone wherein said treating agent reacts with ash-forming components in said oil and an effluent is continuously withdrawn from said first reaction zone and subjected to filtration after removal of water therefrom, the filtration rate and the level of ash reduction can both be increased by introducing said feedstream into said first reaction zone by passing the same through a centrifugal pump along with portions of the contents of said first reaction zone.

The present invention is applicable to the de-ashing of any suitable lubricating oil. The invention is particularly applicable to the purification of oils that have been used for internal combustion lubrication purposes such as crankcase oils, e.g., in gasoline engines or diesel engines. Other sources of used oils include steam-turbine oils, transmission and gear oils, steam-engine oils, hydraulic oils, heat-transfer oils and the like.

The oils generally used for preparing internal combustion engine lubricants are the refinery lubricating cuts from paraffin-base, mixed-base, or naphthenic crudes. Their viscosities are generally in the range of from about 100 to about 1,800 SUS at 100° F. The oils also contain various additives such as oxidation inhibitors (e.g., barium, calcium and zinc alkyl thiophosphates, di-t-butyl-p-cresol, etc.), antiwear agents (e.g., organic lead compounds such as lead diorganophosphorodithioates, zinc dialkyldithiophosphates, etc.), rust inhibitors (e.g., calcium and sodium sulfonates, etc.), dispersants (e.g., calcium and barium sulfonates and phenoxides, etc.), viscosity index improvers (e.g., polyisobutylenes, poly(alkylstyrenes), etc.), detergents (e.g., calcium and barium salts of alkyl benzene sulfonic acids) and ashless-type detergents such as alkyl-substituted succinimides, etc.

If desired, water entrained in the untreated used lubricating oil can be removed before use of same in the process of this invention. Such a separation can be readily achieved by removal of the water phase which may occur in the storage tanks for the used lubricating oil.

The ammonium salt treating agents which are useful in the process of the present invention are those selected from the group consisting of ammonium sulfate, ammonium bisulfate, ammonium phosphate, diammonium hydrogen phosphate, ammonium dihydrogen phosphate, ammonium thiosulfate, ammonium polyphosphates such as ammonium metaphosphate, urea sulfate, guanidine sulfate, urea phosphate, and guanidine phosphate, and mixtures thereof. Said treating agents can be formed in situ if desired as, for example by combining ammonia and/or ammonium hydroxide with sulfuric acid and/or phosphoric acid and/or an ammonium hydrogen sulfate or phosphate, i.e., ammonium bisulfate, diammonium hydrogen phosphate, and/or ammonium dihydrogen phosphate. When the treating agent is formed in situ, the reactants employed can be introduced at the same time, or one after the other.

Although the concentration of treating agent in the aqueous solution of treating agent is not critical and more dilute solutions can be used, the economics of the process are enhanced by the use of relatively concentration solutions in order that the amount of water to be removed subsequently will not be great. Generally, the concentration of treating agent in the aqueous solution will be within the range of about 30 to about 95 weight percent, typically about 80 weight percent, of that in an aqueous solution that is saturated with the treating agent at 25° C. Frequently some water will be found in used oil, and in these instances the concentration of the treating agent can be adjusted accordingly.

In the process of this invention, the treating agent should preferably be employed in an amount at least sufficient to react with essentially all of the metal constituents in the used oil. Although the weight ratio of the treating agent to the used oil can very greatly, depending in part upon the nature and concentration of metal-containing components in the oil and on the particular treating agent employed, generally it will be within the range of about 0.002:1 to about 0.05:1, most often being within the range of about 0.005:1 to about 0.015:1, and typically being about 0.01:1. Although larger amounts of treating agent can be used, in most instances this would be wasteful of treating agent.

To illustrate further the overall process of the present invention, the following descriptions are provided which, taken in conjunction with the attached drawing which is a schematic representation of the process, setting forth the presently preferred modes of operation.

Referring now to the drawing, used oil from storage tank 101 is passed via line 102 to heater 103. Aqueous treating agent containing diammonium hydrogen phosphate from makeup tank 105 is passed through line 104 and combined with the heated used oil in line 163 from whence the mixture passes to line 152 on the inlet side of a centrifugal pump 153. Recycle line 152 is connected to contactor in such a fashion that the pump 153 will result in the recycling of the contents of contactor 106. If needed a heater 154 can be employed between the pump 153 and the inlet of contactor 106. Stirring means also can be employed in contactor 106.

Effluent from contactor 106 is passed via conduit 107 to second contactor 109, which is maintained at a temperature in the range of about 110° to about 140° C., for a time sufficient to effect distillation of a major portion of the water and at least some of the light hydrocarbons present therein. Thus, while retained in contactor 109, essentially all of the water and at least a portion of the light hydrocarbon components of the mixture are removed via line 110 amd passed to separator 111 wherein a hydrocarbon layer and a water layer are allowed to form. The hydrocarbon phase can then be transferred via line 112 to storage 113. The water layer can be removed and discarded or employed for any desired purpose. Preferably, a recycle stream is passed through conduit 155 to pump 156 and then through heater 108 before its return to contactor 109, thereby providing heat and agitation to the contents of the reactor. Stirring means also can be employed.

The resulting residual mixture comprising a hot oil phase which is essentially free of water is passed via conduit 114 to a third contactor 116 wherein the mixture is admixed with diatomaceous earth which is introduced to contactor 116, preferably as a slurry in light hydrocarbons recovered from the integrated process, via conduit 118 from makeup tank 119. Preferably, a recycle stream is passed through conduit 157 to pump 158 and then through heater 115 before its return to contactor 116, thereby providing heat and agitation to the contents of the contactor. Any residual water and light hydrocarbon components are removed from contactor 116 via line 159.

If desired, any one or two or all of contactors 106, 109 and 116 can be provided with jackets heated by steam or other source of heat to aid in maintaining the contents of the contactors at the desired temperatures. Any one or two or all of contactors 106, 109 and 116 can be equipped with stirrers to provide additional agitation. In an operable but presently less preferred arrangement, a stirrer in any one or more of contactors 109 and 116 can be used instead of the recycle system employed with the corresponding one or more of those contactors, any additional heating being provided by heaters in the line ahead of the contactors and/or by heated jackets around the contactors. Furthermore, if desired, the process can be conducted without contactor 116, in which instance the diatomaceous earth can be passed through conduit 118 into conduit 114 from which the resulting mixture comprising oil, solid impurities and diatomaceous earth can be passed directly to filter 121. Also, if desired, any of conduits 107 and 114 can feed into the recycle stream for contactors 109 and 116, respectively, i.e., into conduits 155 and 157, respectively, instead of directly into the respective contactor as shown.

Following admixture of diatomaceous earth, the resulting hot mixture is passed via line 117 to filter 121, which optionally can be precoated with diatomaceous earth. If desired, other filter aids such as perlite or cellulose fibers can be used.

Filter cake from filter 121 is removed via line 147 and optionally passed to furnace 148 from which, following burning or calcination, at least a portion of the resulting ash comprising diatomaceous earth can be passed to waste via line 149 or recycled via conduits 120 and 160 to slurry makeup tank 119 for further use in the system. Fresh diatomaceous earth is added through conduit 160. Light hydrocarbons for use in preparing the slurry can be recovered from the integrated process and can be passed to tank 119 via conduit 151.

In carrying out the process of this embodiment of the invention, a beneficial increase is achieved in the filter rate of the oil through filter 121 when the oil-reagent mix is maintained in admixture for a period of at least 10 minutes at a temperature of 60° to 120 ° C. prior to further processing.

Thus, the hot filtered oil, being essentially free of ash-forming constituents previously contained therein, is suitable for a variety of industrial uses and, if desired, can be removed from the system via line 123.

However, in the presently preferred integrated process of this invention, the hot oil following filtration is passed via line 122 to heater 125 in order to raise the oil to a temperature in the range of 200° to 480° C. for further processing. If desired, a first portion of hydrogen is added thereto via line 124. The resulting hot oil containing the added hydrogen is then passed through contactor 126 wherein decomposition is effected of the sulfonates contained in the oil.

While it is presently preferred that contactor 126 contain bauxite or an activated carbon adsorbent bed therein, this unit can employ other adsorbents such as those selected from the group consisting of silica gel, clay, activated alumina, combinations thereof, and the like. The adsorbent serves to effect breakdown and decomposition of the ammonium salts of sulfonic acids and the ashless detergents contained in the oil. The adsorbent further serves to collect a small portion of the resulting products and thus precludes passage of such undesirable decomposition products to the hydrotreater. Such adsorbents can be regenerated by conventional means and reused.

While less preferred, it is also possible to omit contactor 126 and to remove the small amount of ash components and highly polar materials present in the low-ash, filtered oil by heating the oil to a temperature within the range of about 300° to 410° C., e.g., about 380° C., in the presence of hydrogen and an adsorbent suspended in the oil. After such treatment, the oil is cooled to a temperature within the range of about 60° to 200° C., e.g., about 150° C. and refiltered. The same adsorbents cited above for use in fixed-bed contactors are suitable for this contact-treating process and give similar results.

Preferably, the adsorbent contains about 0.2 to about 20 weight percent of at least one metal selected from the group consisting of Group VIB and Group VIII metals, this weight percent being based on the total weight of modified adsorbent. This modified adsorbent can be prepared by impregnation of the adsorbent with an aqueous solution of a water-soluble compound of a Group VIB or Group VIII metal, followed by evaporation of water. Water-soluble compounds presently preferred for this use are iron compounds such as ferric ammonium oxalate, ferric ammonium citrate, ferric sulfate, and ferrous ammonium sulfate.

The resulting treated oil is thereafter passed from contactor 126 via line 127 to hydrotreater 128, which is maintained at an elevated temperature, which serves to effect destruction of the various additive systems previously added to the original oil stock. Hydrogen for the desired hydrotreating reaction is introduced to the system via line 129 in communication with line 127 or, if desired, directly to the hydrotreater 128.

In hydrotreater 128 the oil is subjected to hydrogenation conditions in the presence of a catalyst so as to hydrogenate unsaturated materials and to effect decomposition of residual sulfur, oxygen and nitrogen bodies so as to yield an oil product suitable for further purification to a lube stock.

Suitable catalysts for use in hydrotreater 128 are those selected from the group consisting of Group VIB and Group VIII metals and combination thereof, on a refractory support, used in conventional hydrodesulfurization processes.

Following hydrotreating, the resulting oil is passed via conduit 130 to separator-reflux column 131 which serves to remove water and various other by-products of the previous treatments from the oil. If desired, and particularly when HCl is present, water can be injected into column 131 to aid in removal of most of any HCl and part of the $H_2S$ and $NH_3$ as water-soluble salts. Overhead from column 131 comprising hydrogen, $H_2S$, $NH_3$, and water is passed via line 132 to sulfur removal unit 133. This unit, for example a bed of zinc oxide, serves to remove $H_2S$ (sulfur) from the hydrogen stream. The resulting sulfur-free hydrogen stream is thereafter passed via line 134 to cooler 135. Ammonia is then removed, for example by water washing in an ammonia removal unit (not shown) in conduit 136. Hydrogen is then recycled via conduit 136 to line 129.

An example of another material useful in unit 133 is iron oxide. Alternatively, a solvent process can be employed using substances such as alkanolamines and/or other amines, the $H_2S$ subsequently being oxidized to sulfur in a Claus-type process.

The bottoms product from column 131 is passed via line 137 to lube-stock stripper 138 wherein a further steam treatment is carried out by introduction of steam via line 139.

Stripping, preferably steam stripping, of the oil is essential to the integrated process of this invention since it serves to remove those light hydrocarbon products boiling below the oil, such as kerosene or heavy gasoline, which have remained entrained in the oil or which are by-products of the hydrogenation treatment. Alternatively, gas stripping such as with hydrogen can be employed.

The resulting hot stripped product, consisting essentially of a pure lube oil stock, following cooling such as by use in heat exchanger 125, is thereafter passed via line 141 to a lube oil stock product tank (not shown) for storage and subsequent use as an additive-free lube oil stock suitable for reformulation with additives as desired.

Overhead from stripper 138, which consists essentially of fuel oil and water, is passed via line 142 to settler 143, where a hydrocarbon phase 144 and a water layer 145 are allowed to form. The hydrocarbon layer 144 is removed via line 146 and combined, if desired, with the hydrocarbon phase in storage tank 113 for further use or recycled to filter aid makeup tank 119 via line 151. The small amount of gases present in line 146 can be removed by flashing.

Depending upon the feedstock, treating agent and other characteristics of a particular operation, as one skilled in the art in possession of this disclosure will understand, the specific conditions of operation gives below can vary, preferably within the approximate ranges which are also given.

| Ref. No. | Unit Description | Typical | Approximate Preferred Ranges |
|---|---|---|---|
| 103 | Heater | Temperature 95° C.<br>Pressure 17 psia | 60°–120° C.<br>Atmospheric–250 psia |

-continued

| Ref. No. | Unit Description | Typical | Approximate Preferred Ranges |
|---|---|---|---|
| 104 | Treating Agent | Weight ratio agt:oil 0.01:1 | 0.005:1-0.05:1 |
| 106 | Contactor | Temperature 95° C.<br>Pressure 17 psia<br>Time 30 minutes | 60°-120° C.<br>Atmospheric-50 psia<br>10 minutes-2 hours |
| 109 | Contactor | Temperature 125° C.<br>Pressure 16 psia<br>Time 30 minutes | 110°-140° C.<br>5-25 psia<br>10 minutes-2 hours |
| 116 | Contactor | Temperature 160° C.<br>Pressure 16 psia<br>Time 30 minutes | 140°-200° C.<br>5-25 psia<br>10 minutes-2 hours |
| 111 | Phase Separator | Temperature 40° C.<br>Pressure atmospheric | 0°-80° C.<br>Atmospheric-45 psia |
| 121 | Filter | Temperature 115° C.<br>Pressure differential plate and frame filter 80 psi<br>Continuous rotary drum filter 10 psi | 60°-200° C.<br>5-100 psi<br>2-14 psi |
| 148 | Furnace | Temperature 760° C.<br>Pressure atmospheric | 650°-870° C.<br>Substantially atmospheric |
| 118 | Filter Aid | Weight ratio aid:oil 0.01:1 | 0:1-0.15:1 |
| 124 | Hydrogen Charge | 111 vol/vol oil | 80-3000 vol/vol oil |
| 125 | Heater | Temperature 370° C.<br>Pressure 735 psia | 200°-480° C.<br>150-3000 psia |
| 126 | Contactor | Temperature 370° C.<br>Pressure 735 psia | 200°-480° C.<br>150-3000 psia |
| 128 | Hydrotreater | Temperature 360° C.<br>Pressure 730 psia | 200°-430° C.<br>150-3000 psia |
| 129 | Hydrogen Charge | 222 vol/vol oil | 80-3000 vol/vol oil |
| 131 | Reflux | Temperature 325° C.<br>Pressure 705 psia | 290°-400° C.<br>600-800 psia |
| 133 | Sulfur Removal Unit | Temperature 290° C.<br>Pressure 700 psia | 150°-430° C.<br>100-3000 psia |
| 135 | Cooler | Inlet temperature 290° C.<br>Outlet temperature 55° C. | 260°-370° C.<br>40°-95° C. |
| 138 | Stripper | Temperature 370° C.<br>Pressure 20 psia | 280°-395° C.<br>Atmospheric-50 psia |
| 143 | Settler | Temperature 55° C.<br>Pressure 16 psia | 0°-80° C.<br>Atmospheric-45 psia |

In the table below there are given typical compositions of the principal streams for the operating conditions above set out.

TABLE II

| | Pounds per Stream Day | | | | | | | | | | | | | |
|---|---|---|---|---|---|---|---|---|---|---|---|---|---|---|
| Stream No. | 102 | 104 | 107 | 117 | 122 | 124 | 129 | 130 | 132 | 134 | 137 | 142 | 146 | 141 |
| Oil | 6644 | | 6644 | 6644 | 6445 | | | 6325 | 32 | 32 | 6293 | 32 | 32 | 6261 |
| Metals plus P* | 51 | | | | | | | | | | | | | |
| S* | 15 | | 13 | 13 | 13 | | | <1 | | | <1 | | | <1 |
| O** | 50 | | 45 | 45 | 44 | | | <1 | | | <1 | | | <1 |
| N* | 10 | | 10 | 10 | 10 | | | <0.1 | | | <0.1 | | | <0.1 |
| $H_2O$ | 417 | 140 | 557 | | | 2 | 2 | 54 | 54 | 61 | | 320 | | |
| $NH_3$ | | | | | | 4 | 4 | 20 | 20 | 20 | | | | |
| $H_2S$ | | | | | | | | 14 | 14 | | | | | |
| Light hydrocarbons | 300 | | 300 | 150 | 150 | | | 275 | 185 | 185 | 90 | 90 | 90 | |
| $(NH_4)_2HPO_4$ | | 70 | | | | | | | | | | | | |
| $CH_4$ | | | | | | 67 | 67 | 137 | 132 | 132 | 5 | 5 | 5 | |
| $H_2$ | | | | | | 66 | 67 | 115 | 114 | 114 | 1 | 1 | 1 | |
| Oil-insolubles | | | 128 | 128 | | | | | | | | | | |
| Diatomaceous earth | | | | 70 | | | | | | | | | | |

*Present in combined form in the used oil.
**Present in combined form in the used oil, excluding $H_2O$.

The following example will further illustrate the invention.

EXAMPLE

A series of studies were carried out using different contacting techniques for reacting a used oil and a diammonium hydrogen phosphate treating agent. The basic apparatus used was a stirred autoclave equipped with a propeller type stirrer which would be operated at either 250 or 500 rpm. A portion of the tests involved contacting the oil and the treating agent in a batch process wherein the oil and treating agent were placed in the autoclave and agitated for a given period of time after which the resulting mixture was dried and filtered. In other of the tests, a continuous flow-through mode was employed wherein oil and treating agent were continuously passed into the reaction zone and effluent, which was continuously removed, was dried and filtered. In still other of the tests, a continuous flow-through mode was employed and in addition a centrifugal pump was used for recycling portions of the contents of the autoclave with the oil and treating agent being supplied to the autoclave by passing through the centrifugal pump along with the flow of recycled material. The results of these evaluations are tabulated in Table I.

TABLE I

| DE-ASHING IN ONE-GALLON AUTOCLAVE | | | | | | | | |
|---|---|---|---|---|---|---|---|---|
| Run Number | 1 | 2 | 3 | 4 | 5 | 6 | 7 | 8 |
| Mode of Operation | Batch | Flow-Through | Batch | Flow-Through | Flow-Through w/Recirculation | | | |
| Autoclave Temperature, °F. | 175 | 260 | 236 | 245 | 260 | 260 | 240 | 220 |
| Mixer Speed RPM | 250 | 250 | 500 | 500 | 500 | 500 | 500 | 500 |
| Nominal Residence Time, Hr. | 1 | ½ | 1 | 1 | ½ | 1 | ½ | ½ |
| Autoclave Pressure, psig | 20 | 0 | 20 | 0 | 50 | 50 | 50 | 50 |
| Prod. Filt. Rate, Gal/hr-ft$^2$ | 19.5 | 9.5 | 21.4 | 9.1 | 12.5 | 12.2 | 18.2 | 25.1 |
| Sulfated Ash of Filtrate, Wt. % | 0.17 | 0.33 | 0.17 | 0.17 | 0.10 | 0.12 | 0.12 | 0.14 |

The data reveals that in batch operation oil could be obtained having filtration rates of 19.5 to 21.4 gal/hr-ft$^2$ and sulfated ash of about 0.17 weight percent. The use of continuous flow-through mode without the attributes of the instant invention resulted in a very significant reduction in the filtration rate. The inventive mode provided better filtration rate than the non-invention flow-through mode and provided a better reduction in ash-forming components then even the batch process.

Reasonable variations and modifications are possible within the scope of the foregoing disclosure, the drawings, and the appended claims of the invention, the essence of which is that there has been provided an improved method for treating used lubricating oil so as to produce an intermediate product of reduced ash content and optionally a final lube oil stock.

What is claimed is:

1. In a process for reducing the concentration of ash-forming components in a used lubricating oil wherein a feedstream comprising said lubricating oil and an aqueous ammonium salt treating agent is continuously passed into a first reaction zone wherein said treating agent reacts with ash-forming components in said oil and an effluent is continuously withdrawn from said first reaction zone and subjected to filtration after removal of water therefrom, the improvement comprising introducing said feedstream into said first reaction zone by passing said feedstream through a centrifugal pump along with portions of the contents of said first reaction zone.

2. A process according to claim 1 wherein said ammonium salt is selected frm at least one salt of the group consisting of ammonium sulfate, ammonium bisulfate, ammonium phosphate, diammonium hydrogen phosphate, and ammonium dihydrogen phosphate.

3. A process according to claim 2 wherein the concentration of ammonium salt in said aqueous solution of a treating agent is in the range of 30 to 95 weight percent of that in an aqueous solution at 25° C. saturated with the treating agent.

4. A process according to claim 3 wherein said treating agent is present in an amount such that the ratio of treating agent to used lubricating oil is in the range of 0.002:1 to 0.05:1.

5. A process according to claim 4 wherein said lubricating oil and said treating agent are contacted in said reaction zone at a temperature in the range of about 60° to about 120° C. for a period of time in the range of about 10 to about 120 minutes.

6. A process according to claim 5 wherein said treating agent comprises diammonium hydrogen phosphate.

7. A process according to claim 6 wherein the filtered oil is subjected to additional processing comprising (1) hydrotreating said oil with hydrogen and a hydrotreating catalyst under conditions of temperature and pressure and time to produce a hydrotreated oil stock substantially free of organic heteroatom compounds, (2) stripping the hydrotreated oil stock to remove light compounds boiling below the desired lubricating oil, and (3) recovering the resulting stripped oil.

8. A process according to claim 2 wherein the filtered oil is subjected to additional processing comprising (1) hydrotreating said oil with hydrogen and a hydrotreating catalyst under conditions of temperature and pressure and time to produce a hydrotreated oil stock substantially free of organic heteroatom compounds, (2) stripping the hydrotreated oil stock to remove light compounds boiling below the desired lubricating oil, and (3) recovering the resulting stripped oil.

* * * * *